US007532165B2

(12) United States Patent
Kim et al.

(10) Patent No.: US 7,532,165 B2
(45) Date of Patent: May 12, 2009

(54) BUILT-IN ANTENNA HAVING CENTER FEEDING STRUCTURE FOR WIRELESS TERMINAL

(75) Inventors: Byung-Nam Kim, Gyeonggi-do (KR); Seung-Yong Lee, Gyeonggi-do (KR)

(73) Assignee: Ace Technology, Incheon (KR)

( * ) Notice: Subject to any disclaimer, the term of this patent is extended or adjusted under 35 U.S.C. 154(b) by 230 days.

(21) Appl. No.: 10/560,381

(22) PCT Filed: Nov. 12, 2003

(86) PCT No.: PCT/KR03/02436

§ 371 (c)(1),
(2), (4) Date: Dec. 13, 2005

(87) PCT Pub. No.: WO2004/112188

PCT Pub. Date: Dec. 23, 2004

(65) Prior Publication Data

US 2007/0103371 A1 May 10, 2007

(30) Foreign Application Priority Data

Jun. 13, 2003 (KR) ..... 10-2003-0038221

(51) Int. Cl.
*H01Q 1/24* (2006.01)

(52) U.S. Cl. ..... 343/702; 343/700 MS

(58) Field of Classification Search ..... 343/702, 343/700 MS, 873, 725, 729
See application file for complete search history.

(56) References Cited

U.S. PATENT DOCUMENTS

| | | | | |
|---|---|---|---|---|
| 5,926,139 | A * | 7/1999 | Korisch | 343/702 |
| 5,936,587 | A * | 8/1999 | Gudilev et al. | 343/752 |
| 6,239,765 | B1 * | 5/2001 | Johnson et al. | 343/795 |
| 6,466,176 | B1 * | 10/2002 | Maoz et al. | 343/767 |
| 6,768,464 | B1 * | 7/2004 | Shoji et al. | 343/702 |
| 7,081,853 | B2 * | 7/2006 | Amano et al. | 343/702 |
| 2002/0118142 | A1 * | 8/2002 | Wang | 343/895 |
| 2003/0006937 | A1 * | 1/2003 | Sekine et al. | 343/702 |
| 2003/0160728 | A1 * | 8/2003 | Fukushima et al. | 343/702 |
| 2004/0104850 | A1 * | 6/2004 | Otaka et al. | 343/700 MS |
| 2006/0017624 | A1 * | 1/2006 | Nagano et al. | 343/702 |
| 2007/0080871 | A1 * | 4/2007 | Ying | 343/702 |

FOREIGN PATENT DOCUMENTS

| | | | |
|---|---|---|---|
| JP | 08-078944 | A | 3/1996 |
| JP | 11-136020 | | 5/1999 |
| JP | 2000-223931 | | 8/2000 |
| JP | 2001-053520 | A | 2/2001 |
| JP | 2001-352212 | A | 12/2001 |
| JP | 2002-100915 | A | 4/2002 |
| JP | 2002-158530 | A | 5/2002 |
| KR | 10-2002-0022490 | A | 3/2002 |
| KR | 10-2002-0027083 | A | 4/2002 |
| WO | WO 02/054532 | A1 | 7/2002 |

* cited by examiner

*Primary Examiner*—HoangAnh T Le
(74) *Attorney, Agent, or Firm*—Venable LLP; Michael A. Sartori; Catherine M. Voorhees

(57) ABSTRACT

A built-in antenna having a center feed structure for wireless terminal. The antenna includes: a feeding means for providing an electromagnetic signal; and a radiating means for radiating the electromagnetic signal, wherein the feeding means is located on a point ranging from a midpoint of the antenna. The antenna radiates a nondirectional signal and can be embedded in a wireless terminal.

11 Claims, 9 Drawing Sheets

BUILT-IN ANTENNA HAVING CENTER FEEDING STRUCTURE FOR WIRELESS TERMINAL

TECHNICAL FIELD

The present invention relates to a built-in antenna for a wireless communication terminal which has a central feed structure.

BACKGROUND ART

As a part of a trend for miniaturizing wireless communication terminal, there is an attempt to set up an antenna inside a wireless communication terminal.

FIG. 1 shows a structure of a conventional built-in antenna having a meander line structure. As shown in the drawing, the conventional built-in antenna 10 includes a radiator 12 for radiating the Global Standard for Mobile Communication (GSM) band, which is 900 MHz, to use multi-bands; a radiator 14 for radiating the Digital Command Signal band (DCS), which is 1800 MHz; and a feed point 16 for supplying electromagnetic signals to the antenna in the upper-left part of the antenna. The antenna 10 is attached to the upper part of a printed circuit board (PCB) of the terminal and thus set up inside the terminal. Here, the PCB is used as a contact surface of the antenna 10.

Meanwhile, since the space for installing the antenna in the terminal is very small, the antenna should be miniaturized while maintaining its performance. Therefore, the feed point 16 is formed at one end of an edge of the antenna 10, as shown in FIG. 1, to obtain the maximum antenna resonance length out of a minimum-sized antenna.

Since the conventional antenna which is mounted on a bar-type or flip-type terminal has a relative wide and fixed contact surface, the internal space of the terminal is very small. Moreover, since the size of the contact surface with the antenna is changed according to whether the folder cover of the terminal is open or closed, the antenna characteristics are degraded seriously. In particular, if the terminal is closed, the antenna contact surface becomes very small. So, the antenna characteristics are degraded seriously in DCS and Personal Communication Service (PCS) band which have relatively short wavelength of 1800 MHz to 1900 MHz.

FIG. 2 shows H-Plane radiation patterns of a folder-type terminal with a built-in antenna having a conventional feed structure. The H-Plane radiation pattern is a significant standard for observing the non-directionality of an antenna.

As shown, when the folder cover of a folder-type terminal is closed, the antenna characteristics are degraded in the 1800 MHz. That is, the transmission and reception is almost impossible in one direction of the terminal, which is the direction of 90° in FIG. 2, and the transmission and reception rate is degraded by more than scores of percentage in the directions of 0° and 180°, too. The degradation characteristics of the antenna having the conventional feed structure becomes known more obviously by interpreting three-dimensional full-waves, which are presented in FIG. 3.

FIG. 3 shows a result of interpreting: three-dimensional full-waves of the folder-type terminal which includes a built-in antenna having the conventional feed structure in the 1800 MHz. As shown, the antenna having a feed point in the upper-left part generates serious null in one direction of a radiation pattern because surface current is distributed only part of the antenna asymmetrically.

As consumers prefer smaller terminals, a demand for a built-in antenna increases continuously. This calls for the development of a small built-in antenna that can support multi-band characteristics and has stable transmission/reception characteristics in a folder-type terminal having a small contact surface, regardless of the open/closed state of the folder-type terminal.

At present, provided are various frequency band services including GSM scheme which occupies about 80% of the world market and DCS scheme. Therefore, an antenna that can perform transmission/reception stably in multibands is required.

In order to satisfy the diverse needs of current customers, terminals are miniaturized more and more and the miniaturization of terminals calls for the development of a built-in antenna that can be mounted on a small terminal. Also, a small built-in antenna with stable transmission/reception characteristics even in a folder-type terminal, of which internal space is very small and contact surface is changed according to whether the folder cover is open or closed, is in a desperate need.

DISCLOSURE OF INVENTION

It is, therefore, an object of the present invention to provide a built-in antenna that can be mounted on a terminal with a small antenna contact surface by positioning a feed point supplying electromagnetic signals in the center of the antenna to thereby have a non-directional radiation pattern.

Other objects and advantages will be described hereinafter and understood from the embodiments of the present invention. Also, the objects and advantages of the present invention can be embodied by the means described in the claims and combinations thereof.

In accordance with one aspect of the present invention, there is provided a built-in antenna mounted inside a wireless communication terminal, the antenna which includes a feed point for supplying electromagnetic signals to the antenna; and a radiator for radiating electric waves based on the supplied electromagnetic signals, wherein the feed point is positioned within about 30% distance radius based on the center of the antenna and non-directional waves are radiated.

In accordance with another aspect of the present invention, there is provided the built-in antenna further including a short circuit line for partially radiating the supplied signals, the short circuit line being positioned in a contact short circuit pin and between the short circuit pin and the feed point.

Preferably, the short circuit line has a meander link structure having inductance to offset the capacitance of a human body.

BRIEF DESCRIPTION OF DRAWINGS

The above and other objects and features of the present invention will become apparent from the following description of the preferred embodiments given in conjunction with the accompanying drawings, in which.

BEST MODE FOR CARRYING OUT THE INVENTION

Other objects and aspects of the invention will become apparent from the following description of the embodiments with reference to the accompanying drawings, which is set forth hereinafter. The terms and words used in the present specification and claims should not be construed to be limited to conventional meaning or meaning in dictionaries, but they should be understood to have meaning and concepts in agreement with the technical concept of the present invention based on a principle that an invention can define terms to describe his invention in the most proper manner.

Therefore, the embodiment described in the present specification and the structures of the drawings are no more than a preferred embodiment of the present invention and do not show all the technical concept of the present invention. So, it should be understood that there are or will be various equivalents and modifications to replace the elements presented in the present specification at a time point when the specification of the present invention is filed.

Hereinafter, a built-in antenna mounted on a multi-band terminal that supports a Global Standard for Mobile Communication (GSM) band (900 MHz) and a Digital Command Signal (DCS) band (1800 MHz) simultaneously in a recent attempt to provide an international roaming service will be taken and described as an embodiment of the present invention. However, it is obvious to those skilled in the art that the present invention is not limited to what is described in the embodiment but it can be applied to all types of terminals including a terminal using a single Personal Communication Service (PCS) band or a triple US-PCS band.

Figure 4:
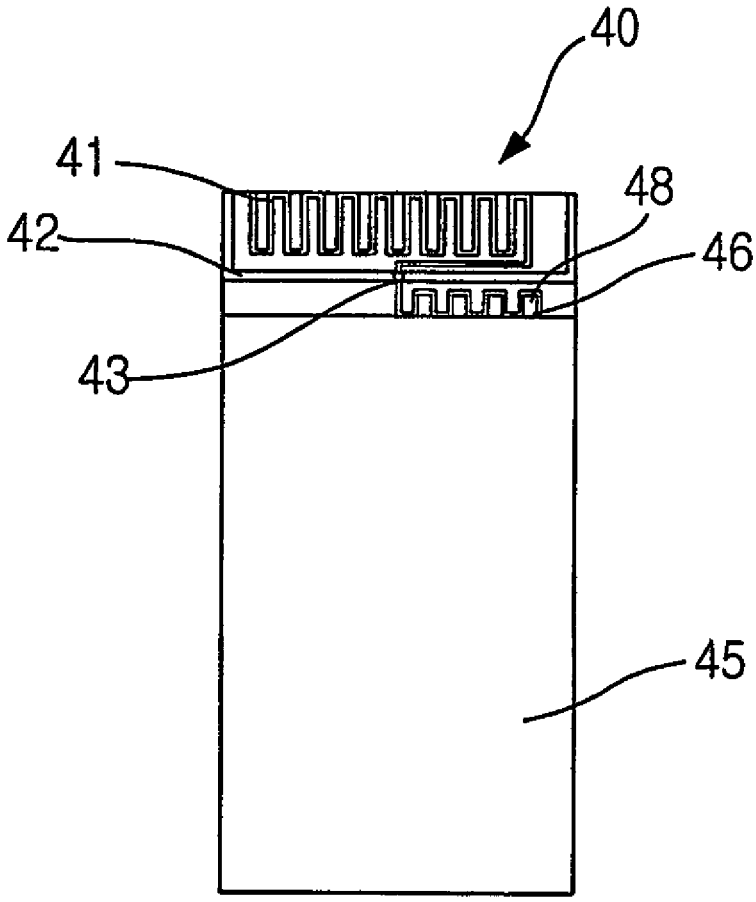
FIG. 4 is a plane view showing a built-in antenna in accordance with a first embodiment of the present invention.

FIG. 4 is a plane view showing a built-in antenna 40 in accordance with a first embodiment of the present invention.

As shown, the built-in antenna 40 of the present invention includes a feed point 43, a first radiator 41, and a second radiator 42. The feed point 43 supplies electromagnetic signals, and the first radiator 41 releases the GSM band electric waves with respect to the supplied electromagnetic signals. The second radiator 42 releases the DCS band electric waves.

As shown in FIG. 4, it is desirable to minimize offset current and cause constructive interference by making the first radiator 41 and the second radiator 42 release the electromagnetic signals in the same direction.

Also, the second radiator 42 has branches stretched out in both right and left directions with the feed point at the center so that the electromagnetic signals of the DCS band are distributed to the entire contact surface 45 of the terminal and thus non-directional waves are released.

The first and second radiators 41 and 42 are formed of conductive wires having a width of $1.5\times10^{-3}\ \lambda_0$. Preferably, the first radiator 41 has a meander line structure which is a winding structure and the interval between the branches is $2.0\times10^{-3}\ \lambda_0$ and the total length is $0.7\ \lambda_0$. The entire length of the second radiator 42 is $0.35\ \lambda_0$. Here, $\lambda_0$ denotes the wave length of the electric wave at a resonance frequency that is released by the second radiator 42.

More preferably, the conductive wire is nickel-plated copper having a thickness of $0.6\times10^{-3}\ \lambda_0$.

Since the feed point 43 is placed not at the end of the antenna but in the center of the contact surface, which is different from conventional antennas, the resonance length may not be sufficiently long. Therefore, as presented in the drawing, a short circuit pin 46 and a short circuit line 48 are provided to help the antenna release the supplied electromagnetic signals. The short circuit pin 46 shorts the antenna 40 with the contact surface 45 of the terminal, and the short circuit line 48 has the same length as that of the second radiator 42 between the feed point 43 and the short circuit pin 46.

Preferably, the short circuit line 48 is formed in the meander line structure having an inductance component to offset the capacitance component of a human body, i.e., a user of the terminal.

Figure 5:
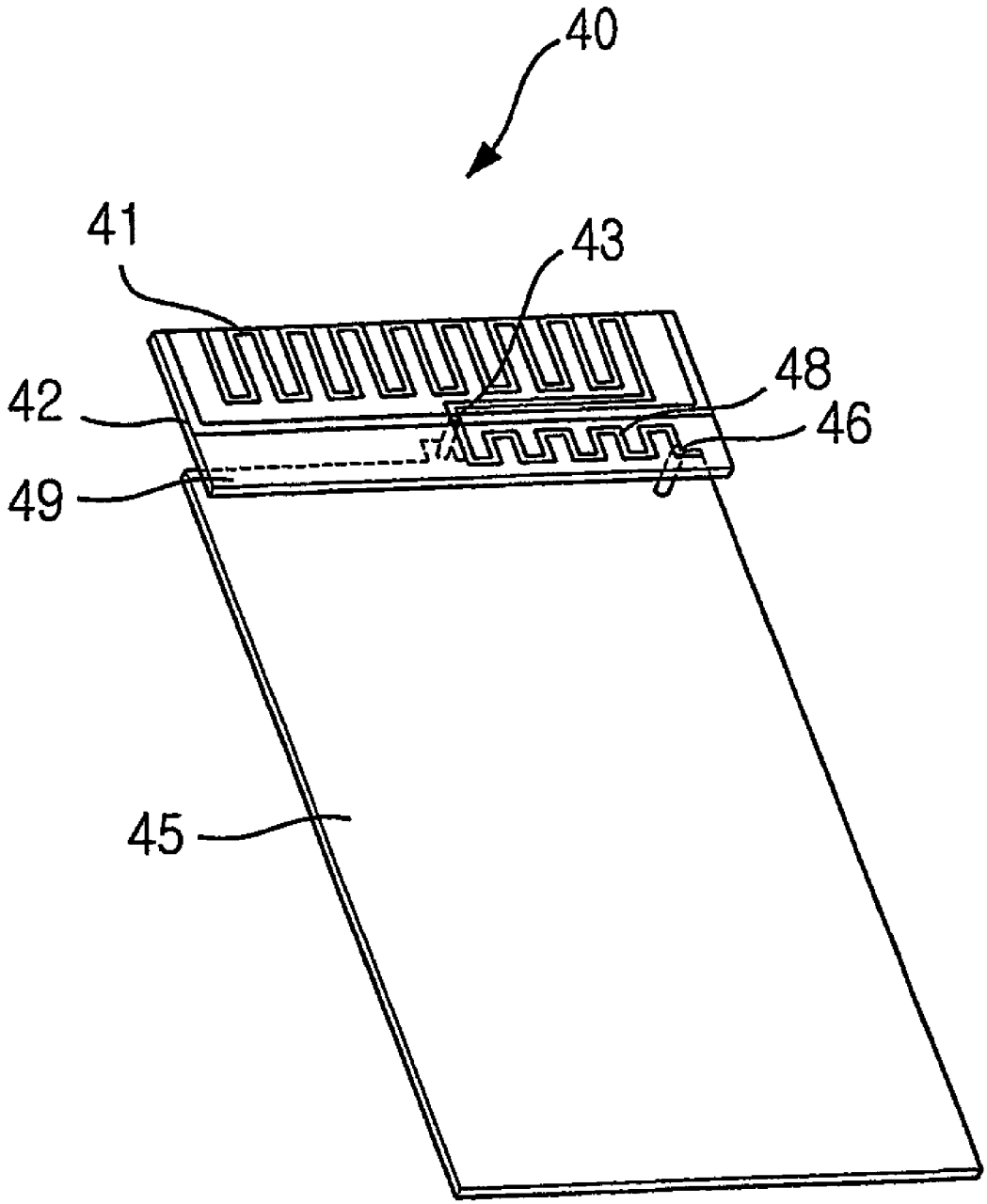
FIG. 5 is a perspective view showing the built-in antenna in accordance with the first embodiment of the present invention.

The structure of the first embodiment can be understood more clearly with reference to FIG. 5. FIG. 5 is a perspective view showing the built-in antenna in accordance with the first embodiment of the present invention. Reference numerals that also appear in FIG. 4 indicate the same elements performing the same function.

The reference numeral '49' indicates a frame obtained by injection-molding polycarbonate (PC)-acrlonitrile butadiene styrene (ABS) mixture or, in some cases, PC to enhance the hardness. The frame 49 performs a function of supporting the radiator.

Figure 6:
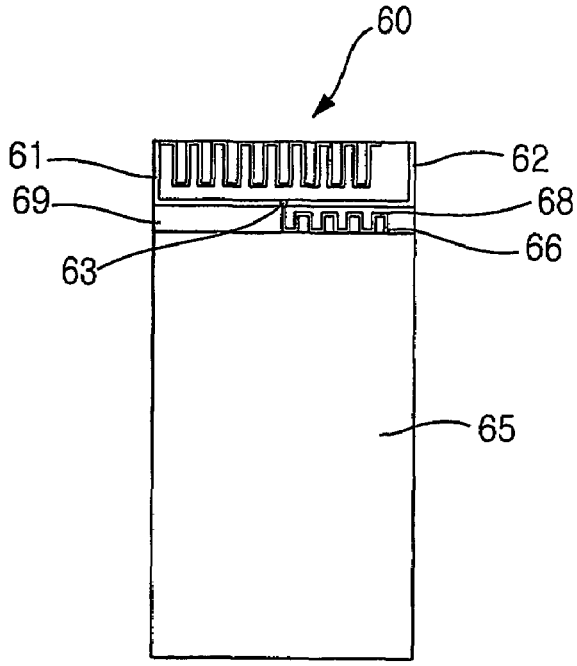
FIG. 6 is a plane view showing a built-in antenna in accordance with a second embodiment of the present invention.

FIG. 6 is a plane view showing a built-in antenna in accordance with a second embodiment of the present invention. Differently from the first embodiment, the second embodiment of the present invention has the GSM band radiator and the DCS band radiator stretched in the opposite direction to that of the first embodiment with the feed point at the center. The others except the direction of radiators are the same as the first embodiment. Thus, further description on the coinciding structure will be omitted herein for convenience in description.

Referring to FIG. 6, a feed point 63 is positioned in the right and left center of an antenna 60. A first radiator 61 of the GSM band and a second radiator of the DCS band are stretched to the right and left of the antenna 60 based on the feed point 63.

The first radiator 61 having a meander line structure is positioned in the upper part of a second radiator 62, which is depicted in the drawing.

Also, a contact surface 65 and a short circuit pin 66 shorts the antenna 60 with the terminal. The feed point 63 and the short circuit pin 66 are connected by the short circuit line 68 having a meander line structure. The structure and function of the short circuit line 68 are the same as the first embodiment.

Also, the first radiator 61, the second radiator 62 and the short circuit line 68 is supported by a frame 69 obtained by injection-molding a PC-ABS mixture and mounted in the inside of the terminal.

Figure 7:
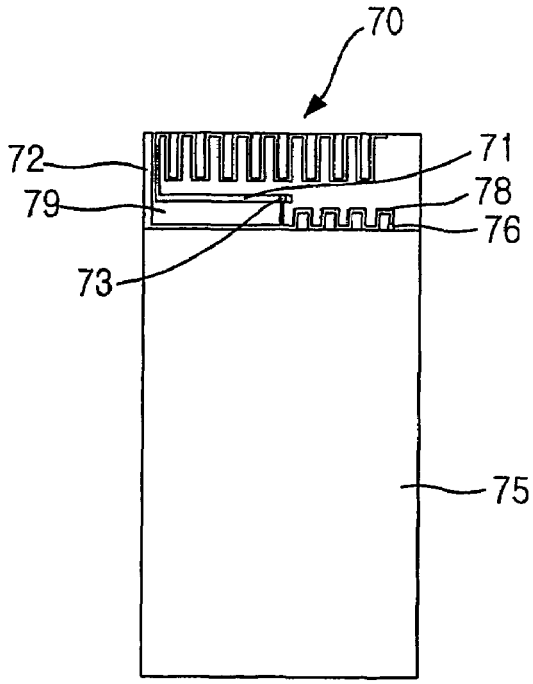
FIG. 7 is a plane view showing a built-in antenna in accordance with a third embodiment of the present invention.

FIG. 7 is a plane view showing a built-in antenna in accordance with a third embodiment of the present invention. Differently from the first embodiment, the third embodiment of the present invention has a GSM band radiator and a DCS band radiator branching out in the same direction from a feed point. Except the direction of the radiators, all the others are the same as the first embodiment. Therefore, further description on the coinciding structures will be omitted.

Referring to FIG. 7, the feed point 73 is positioned in the right and left center of the antenna 70, and a first radiator 71 of the GSM band and a second radiator 72 of the DCS band are stretched out to the left of the antenna from the feed point 73.

The first radiator 71 has a meander line structure and positioned in the upper part of the second radiator 72.

A contact surface 75 and a short circuit pin 76 shorts the antenna 70 with the terminal. The feed point 73 and the short circuit pin 76 are connected by the short circuit line 78 having a meander line structure. The short circuit line 78 is positioned in the opposite direction to the firsthand second radiators 71 and 72, and the structure and function of the short circuit line 68 are the same as the first embodiment.

Also, the first radiator 71, the second radiator 72 and the short circuit line 78 is supported by a frame 79 obtained by injection-molding a PC-ABS mixture and mounted in the inside of the terminal.

Figure 8:
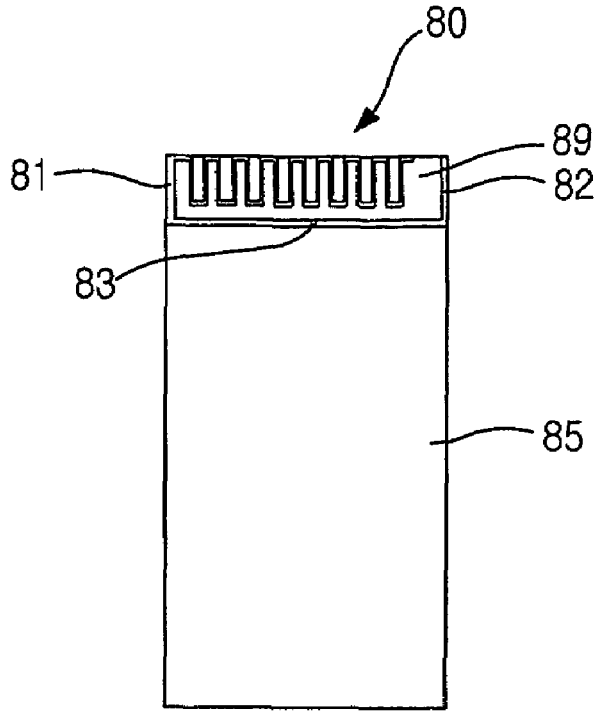
FIG. 8 is a plane view showing a built-in antenna in accordance with a fourth embodiment of the present invention.

FIG. 8 is a plane view showing a built-in antenna in accordance with a fourth embodiment of the present invention. Differently from other embodiments, the fourth embodiment does not use the short circuit pin and the short circuit line. Since a feed point 83 is positioned in the center of the right and left parts of the antenna in the fourth embodiment, a sufficient resonance length may not be acquired. Therefore, it is desirable to fabricate the radiators about 30 to 40% longer than those of the first embodiment. The other structures and functions are the same as the first embodiment.

Referring to FIG. 8, an antenna 80 is positioned in the upper part of a contact surface 85, and a feed point 83 for supplying electromagnetic signals is positioned in the right and left center of the antenna 80. Based on the feed point 83, a first radiator 81 of the GSM band and a second radiator 82 of the DCS band are stretched out in the opposition direction.

The first radiator 81 has a meander line structure and positioned in the upper part of the second radiator 82. It is desirable to make the first and second radiators 81 and 82 release electromagnetic signals in the same direction in order to minimize offset current and cause constructive interference.

Also, the first and second radiators 81 and 82 are supported by a frame 89 which is obtained by injection-molding PC-ABS mixture and placed in the inside of the terminal.

Figure 9:
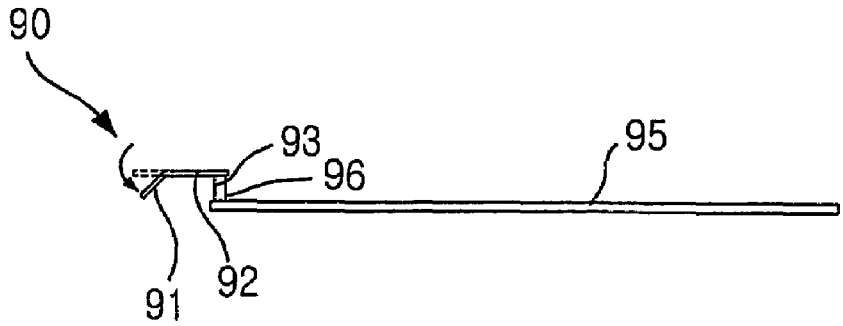
FIG. 9 is a side view showing a built-in antenna in accordance with a fifth embodiment of the present invention.

FIG. 9 is a side view showing a built-in antenna in accordance with a fifth embodiment of the present invention. Therefore, the antenna 90 positioned in the upper part of a contact surface 95 includes a first radiator 91, a second radiator 92, a feed point 93, and a short circuit pin 96. The first radiator 91 releases GSM-band electric waves and the second radiator 92 releases DCS-band electric waves. The feed point 93 supplies electromagnetic signals to the antenna 90, and the short circuit pin 96 shorts the antenna 90 to the contact surface 95 of the terminal.

In this embodiment of the present invention, the hand effect, which means loss by the contact to a human body, can be reduced by making an outward turn on the entire or part of the first radiator 91 that is positioned in the upper part of the antenna 90. As shown in FIG. 9, since the first radiator 91 is turned outward from the antenna 90, it can be far from the human body using the terminal, thus reducing the hand effect.

In FIG. 9, the broken line shows the first radiator 91 before the first radiator 91 is turned outward, and the straight line shows the first radiator 91 after it is turned outward. The first radiator 91 can be turned outward perpendicularly or diagonally based on the plane surface of the second radiator 92.

The above embodiment describes a case where the feed point is positioned in the right and left center of the antenna. However, as long as the feed point is positioned within about 30% distance radius from the center of the, antenna, the result is similar to a case where the feed point is in the central point. To be specific, if the feed point is positioned at a location of $$\frac{1}{4}\lambda$$

from an end of the radiator, fine characteristics are acquired. Therefore, the present invention is not limited to a case where the feed point is positioned in the right and left center point of the antenna.

Figure 10:
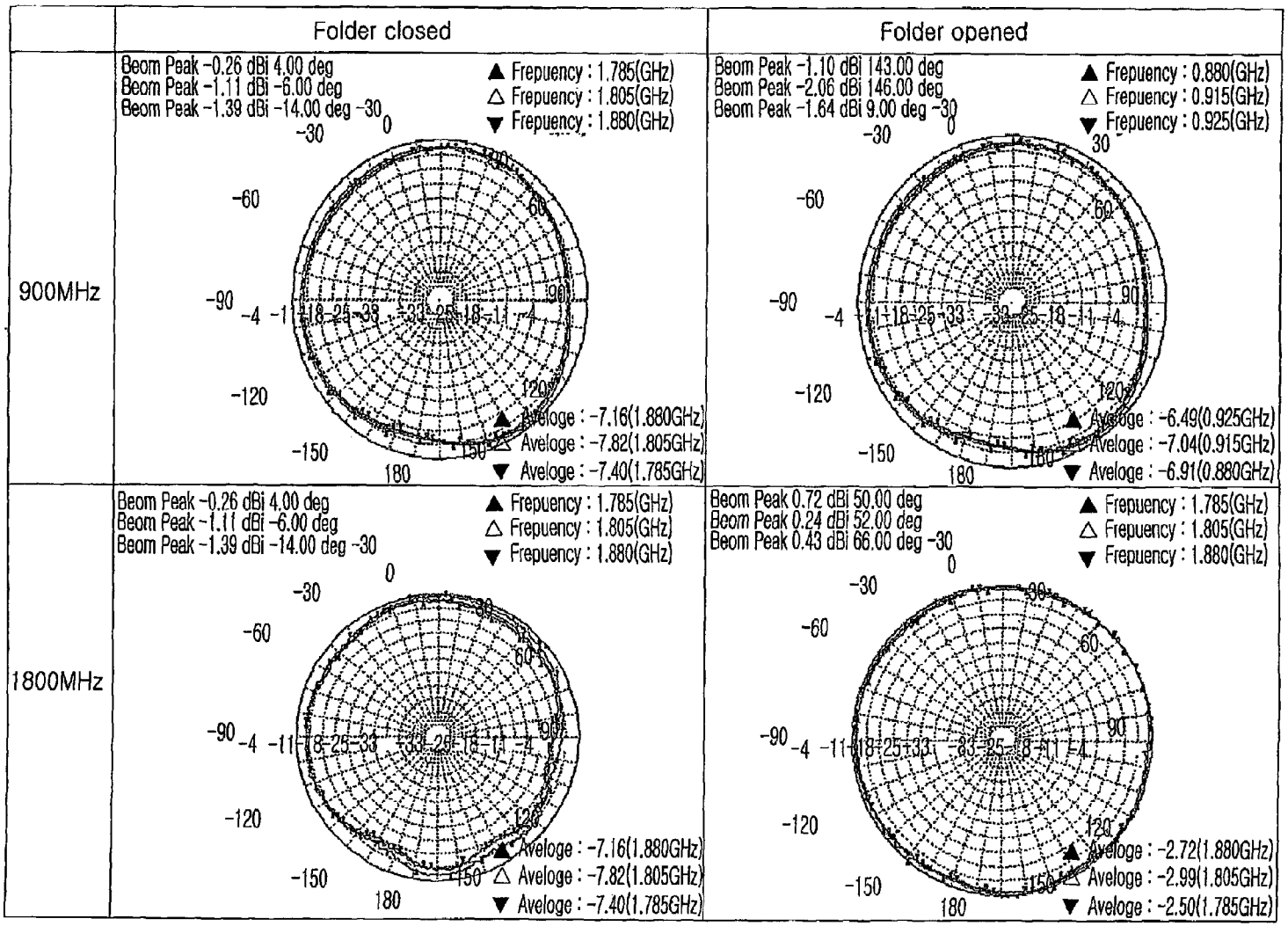
FIG. 10 presents graphs showing H-Plane radiation patterns of a folder-type terminal having a built-in antenna in accordance with the present invention.

FIG. 10 presents graphs showing H-Plane radiation patterns of a folder-type terminal having a built-in antenna in accordance with the present invention. As mentioned before, an H-Plane radiation pattern is a significant standard for figuring out the non-directionality of an antenna.

Figure 1:
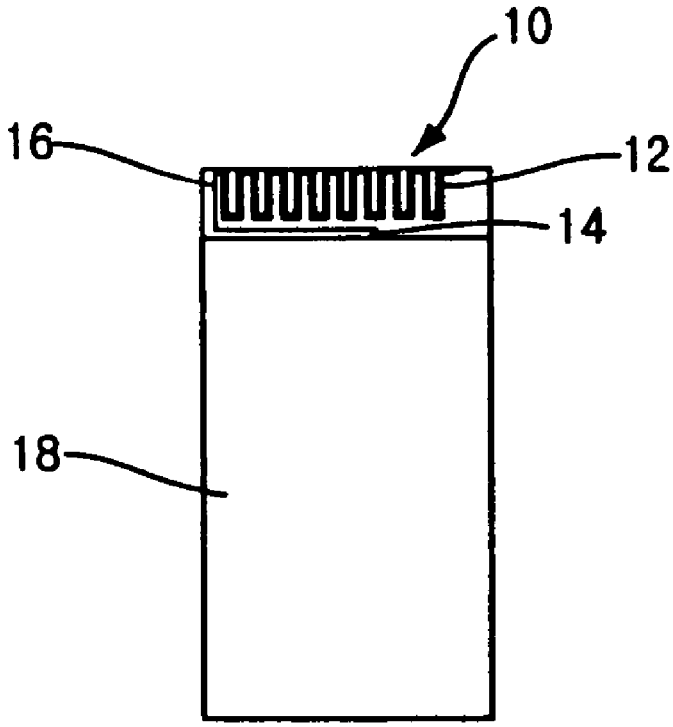
PRIOR ART FIG. 1
FIG. 1 is a plane view showing a built-in antenna having a conventional meander link structure.
Figure 2:
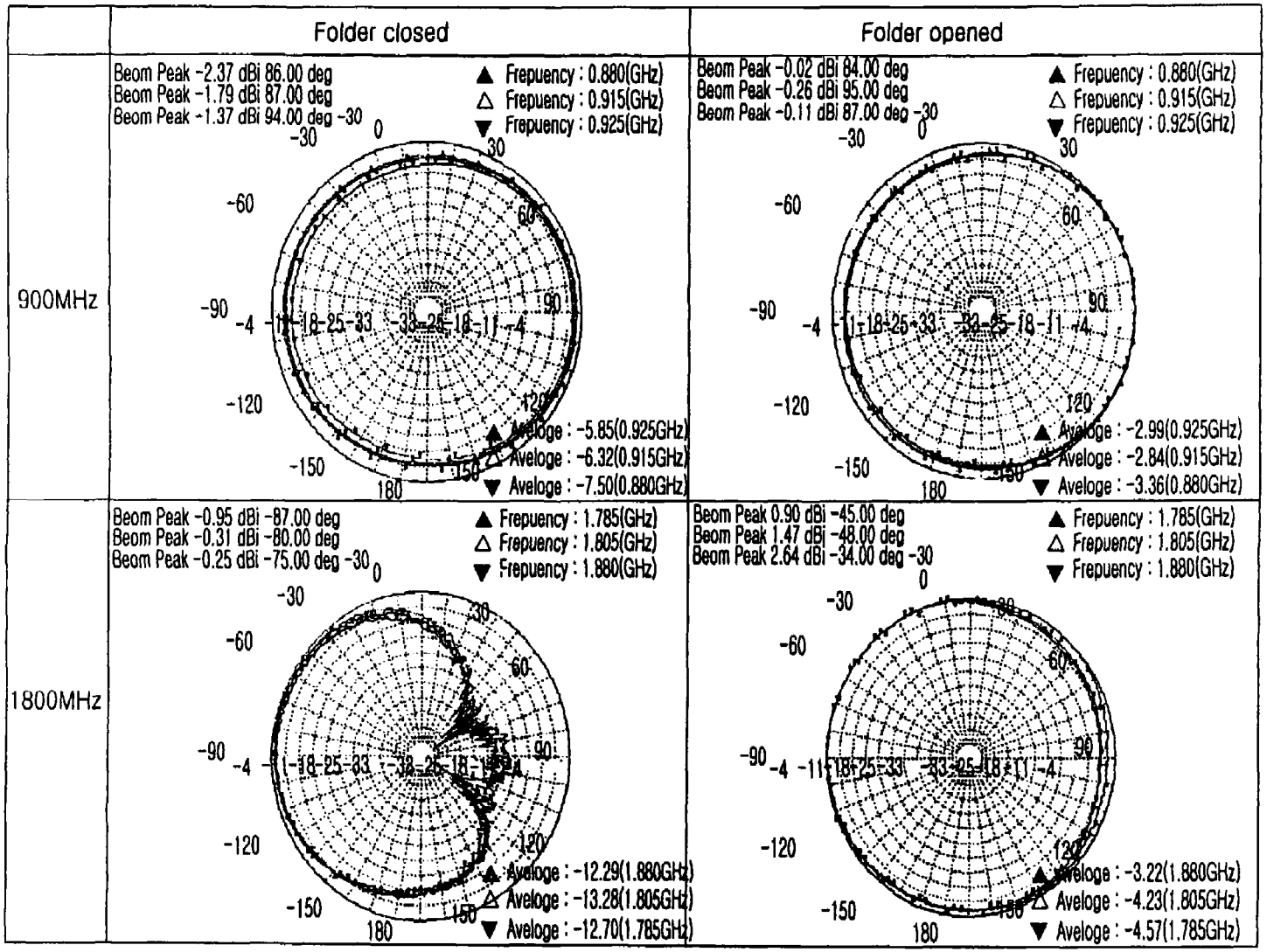
FIG. 2 PRIOR ART
FIG. 2 presents graphs showing H-Plane radiation patterns of a folder-type terminal having a built-in antenna of a conventional feed structure.

As shown, the performance of the antenna is maintained regardless of the closed or open state of a folder cover in the DCS band (1800 MHz). The outstanding result of the present invention is evident when it is compared with the result of the conventional antenna, which is shown in FIG. 2.

In short, the performance of the built-in antenna of the present invention is not degraded even when the contact surface becomes very small, for example, when the folder cover is closed in a folder-type terminal.

The characteristics of the antenna having a central feed structure can be understood more obviously through three-dimensional full-wave interpretation.

Figure 11:
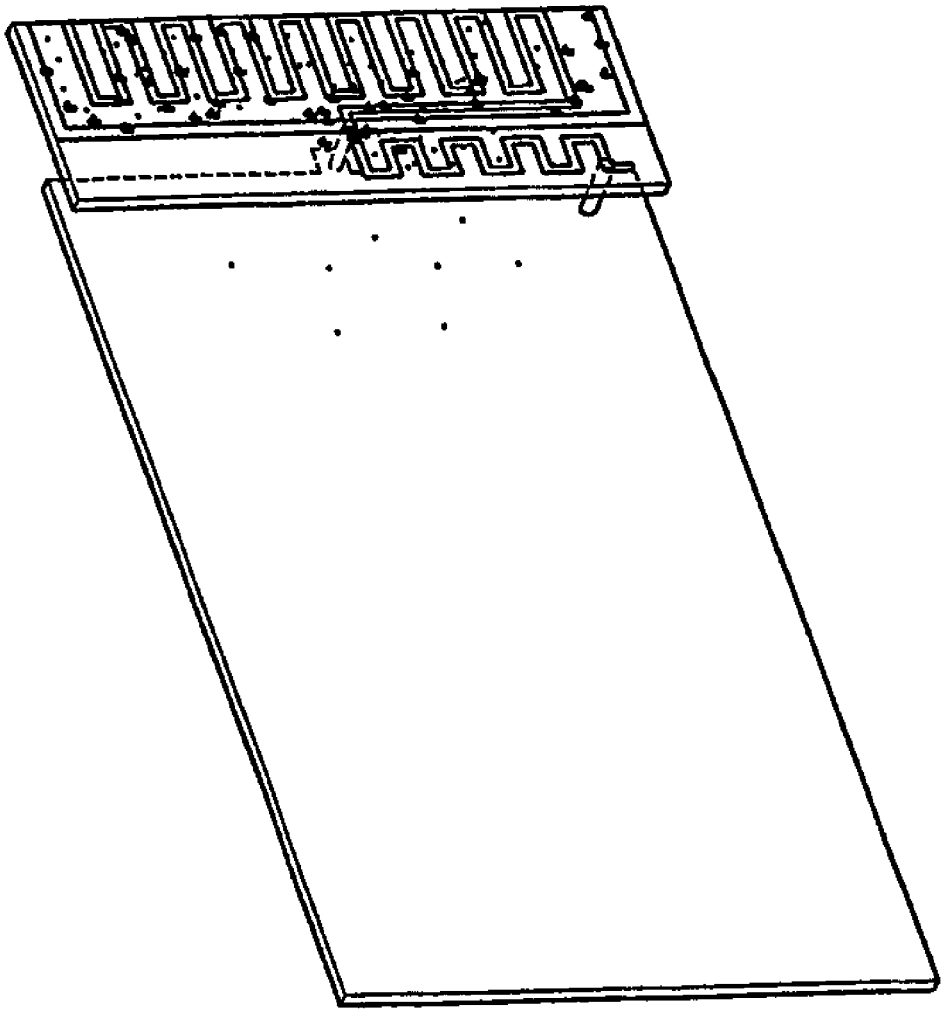
FIG. 11 is a photograph obtained by interpreting three-dimensional full-waves of a folder-type terminal having a built-in antenna of a central feed structure in the 1800 MHz band in accordance with the present invention.

FIG. 11 is a photograph obtained by interpreting three-dimensional full-waves of a folder-type terminal having a built-in antenna of a central feed structure in the 1800 MHz band in accordance with the present invention.

Figure 3:
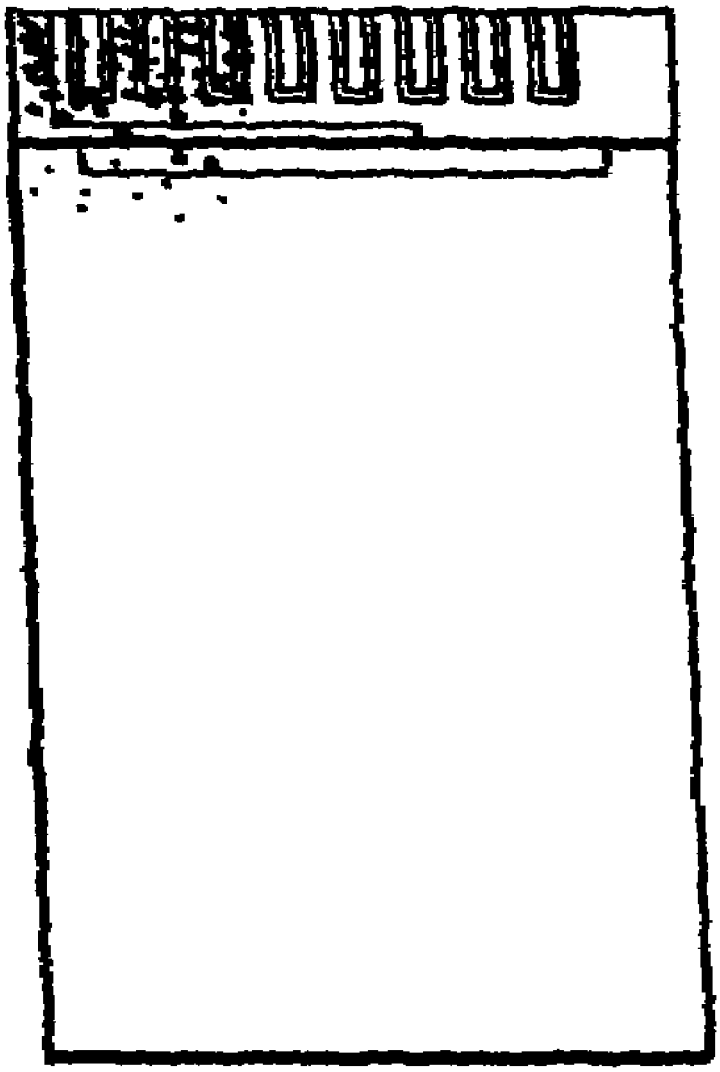
FIG. 3 PRIOR ART
FIG. 3 is a photograph obtained by interpreting three-dimensional full-waves of the folder-type terminal having the built-in antenna of the conventional feed structure in the 1800 MHz band.

As shown, surface current is distributed evenly to the entire antenna and non-directional electric waves are released. This result of the present invention can be understood easily when it is compared with the experimental result of the conventional antenna which is shown in FIG. 3.

As the experimental results show, the built-in antenna of the present invention having a central feed structure can prevent the degradation of the transmission/reception characteristics of the antenna by positioning the feed point at the center, instead of an end of the antenna, even though the terminal is very small. To be specific, it can receive electromagnetic signals from all 360° directions, even if the folder cover of a folder-type terminal is closed.

The antenna of the present invention can secure performance equal to or better than the bar-type terminal even in the folder-type terminal. Therefore, it will stimulate the commercialization of the second generation built-in antenna, i.e., a built-in antenna for a folder-type terminal, following the conventional built-in antenna for a bar-type terminal which is commercialized first.

While the present invention has been described with respect to certain preferred embodiments, it will be apparent to those skilled in the art that various changes and modifications may be made without departing from the scope of the invention as defined in the following claims.

What is claimed is:

1. A built-in antenna mounted on the inside of a wireless communication terminal, comprising:

a feed point for supplying electromagnetic signals to the antenna;

a first radiator for releasing the electromagnetic signals in a first band of electromagnetic waves;

a short circuit pin for grounding the antenna; and a short circuit line for releasing the supplied signals partially, the short circuit line being positioned between the short circuit pin and the feed point, and the short circuit line having a length which is half of the first radiator's electrical length, wherein the feed point is positioned substantially center of the electrical length of the first radiator and the electric waves are released omni-directionally.

2. The built-in antenna as recited in claim 1, wherein the feed point is positioned at a location of $$\frac{1}{4}\lambda$$

from an end of the first radiator, wherein $\lambda$ denotes a wavelength.

3. The built-in antenna as recited in claim 1, wherein the short circuit line has a meander line structure.

4. The built-in antenna as recited in claim 1, further comprising:

a second radiator for releasing a second band of electromagnetic waves, the second radiator being stretched out to an end of the first radiator.

5. The built-in antenna as recited in claim 4, wherein the first radiator is stretched out in both right and left directions based on the feed point and releases omni-directional electromagnetic waves by distributing the first band electromagnetic signals to an entire contact surface.

6. The built-in antenna as recited in claim 4, wherein the first and second radiators comprise conductive wires having a diameter of $1.5\times10^{-3}\ \lambda_0$, and the second radiator comprises a meander line structure with a width of $2.0\times10^{-3}\ \lambda_0$ and a total length of $0.7\ \lambda_0$, while the first radiator comprises a total length of $0.35\ \lambda_0$, wherein $\lambda_o$ is a wavelength of electric wave released by the radiator at a resonance frequency.

7. The built-in antenna as recited in claim 6, wherein each of the conductive wires is a nickel-plated copper material having a thickness of $0.6\times10^{-3}\ \lambda_0$ and the conductive wire is supported by a frame, which is obtained by injection-molding polycarbonate (PC)-acrylonitrile butadiene styrene (ABS) mixture, and mounted on the inside of the terminal.

8. The built-in antenna as recited in claim 4, wherein the first and second radiators are formed by using copper tape, and surface coating injection is performed on the surface of the first and second radiators by using a low-pressure injector to prevent corrosion of the surface.

9. The built-in antenna as recited in claim 4, wherein the first and second radiators are formed of flexible printed circuit board (PCB) and fixed by using an adhesive material.

10. The built-in antenna as recited in claim 4, wherein the second radiator is veered vertically or diagonally to a surface including the first radiator so as to make the second radiator relatively far from a hand of a human body.

11. The built-in antenna as recited in claim 4, wherein the first band is Digital Command Signal (DCS) band and the second band is Global Standard for Mobile Communication (GSM) band.

* * * * *